United States Patent [19]

Carver et al.

[11] 4,171,116

[45] Oct. 16, 1979

[54] ADJUSTABLE AND COLLAPSIBLE EASEL

[75] Inventors: George E. Carver, Northbrook; Joseph C. Sindelar, Glen Ellyn, both of Ill.

[73] Assignee: Beckley-Cardy Company, Chicago, Ill.

[21] Appl. No.: 774,134

[22] Filed: Mar. 3, 1977

[51] Int. Cl.[2] ..... A47B 97/04

[52] U.S. Cl. ..... 248/464; 248/465; 248/169; 248/188.5; 248/296

[58] Field of Search ..... 108/144; 248/451–453, 248/464, 465, 434, 435, 168, 169, 170, 171, 188.5, 166; 403/109; 269/236

[56] References Cited

U.S. PATENT DOCUMENTS

| | | | |
|---|---|---|---|
| 274,166 | 3/1883 | Barrie | 248/171 |
| 697,146 | 4/1902 | Howard | 248/188.5 X |
| 1,016,763 | 2/1912 | Nill | 108/144 |
| 1,084,379 | 1/1914 | Wile | 269/236 X |
| 2,039,348 | 5/1936 | Richard | 108/144 |
| 2,064,232 | 12/1936 | Tepper | 248/452 |
| 2,550,550 | 4/1951 | Goodstein | 248/465 X |
| 2,588,399 | 3/1952 | McQuin | 248/170 X |
| 3,915,102 | 10/1975 | Barron | 108/144 |
| 4,017,049 | 4/1977 | Albee | 248/465 X |
| 4,029,279 | 6/1977 | Nakatani | 248/188.5 |
| 4,046,363 | 9/1977 | Whitley | 269/236 X |

FOREIGN PATENT DOCUMENTS 1138238 10/1962 Fed. Rep. of Germany ..... 248/188.5

*Primary Examiner*—Lawrence J. Staab
*Attorney, Agent, or Firm*—Merriam, Marshall & Bicknell

[57] ABSTRACT

An adjustable and collapsible easel having a plurality inner and outer telescoping leg sections. The upper ends of the outer leg sections are connected to a common connecting member for articulated movement between fully spread and fully folded positions. The outer ends of a plurality of foldable brace members are connected to respective ones of the outer leg sections and the inner ends of the brace members are connected to a common fitting. The brace members reinforce and hold the legs in an operative, spread position. Cam surfaces on the outer ends of the brace members engage and prevent telescoping movement of the inner leg sections relative to the outer leg sections when the legs are in either fully spread or fully folded positions. The length of the legs and locking of the same in their operative, fully spread position is effected by depressing the fitting which interconnects the inner ends of the brace members. Support means for supporting an article to be displayed on the easel is slidably and rotatably mounted on at least one of the upper leg sections. Each support means includes a pivotally mounted arm which serves to releasably lock the support means in an adjusted position on its leg section when the arm is pivoted to an outwardly extending, operative position.

13 Claims, 18 Drawing Figures

ADJUSTABLE AND COLLAPSIBLE EASEL

This invention relates to easels, and more particularly relates to an easel which can be erected, adjusted and collapsed without manipulating any threaded fastening devices.

Various types of easels have been developed for displaying and supporting charts, photographs, display boards and the like for viewing during meetings, classroom instruction and exhibitions. While many of the easels heretofore advanced have proved generally satisfactory for their intended purpose, others have suffered from the disadvantages of being non-adjustable in overall height or the position at which an item was supported thereon. In addition, many of the easels heretofore advanced could not be collapsed to a compact size for shipment or storage.

Of the adjustable easels heretofore or presently available, so far as is known, most require manipulation of some type of threaded fastener, such as thumb screws or the like, to effect locking and unlocking of the adjustable parts thereof. In addition to the time required to effect locking and unlocking of the adjustable parts of easels of this type, the thumb screws employed for this purpose were frequently lost or the threads became damaged due to misuse. Consequently, the easel became useless or required repair.

Accordingly, it is a general object of the present invention to provide a novel adjustable and collapsible easel which is not subject to the aforementioned objections and disadvantages.

Another object is to provide a novel adjustable and collapsible easel of the character described, which does not not employ or require manipulation of any type of threaded fastener to effect locking and unlocking of the adjustable parts thereof.

A more particular object is to provide a novel adjustable and collapsible easel having a plurality of telescoping leg sections which are interconnected by an articulated brace having a central hub, wherein depression of the central hub effects spreading of the legs and automatically locks the leg sections in adjusted positions.

Still another object is to provide a novel adjustable and collapsible easel of the foregoing character, wherein raising the central hub from its leg locking position causes the legs to move from fully spread to partially spread positions and effects unlocking of the leg sections to permit relative telescoping movement thereof.

A further object is to provide a novel easel of the foregoing character, wherein the telescoping leg sections are also locked against telescoping movement when the legs of the easel are folded together to a fully collapsed position.

A still further object is to provide a novel adjustable and collapsible easel of the character described, wherein at least one article supporting member is pivotally mounted on an annular mounting member that is longitudinally and rotatably shiftable on a leg of the easel and wherein the mounting member is automatically locked in an adjusted position on the leg when the support member is pivoted from an inoperative folded position to an operative extended position.

Another object is to provide a novel adjustable and collapsible easel which is simple in construction, economical to manufacture and reliable in operation.

These and other objects will become apparent from the following detailed description and accompanying sheets of drawings, in which.

Figures 1, 2, 3, 4, 5:
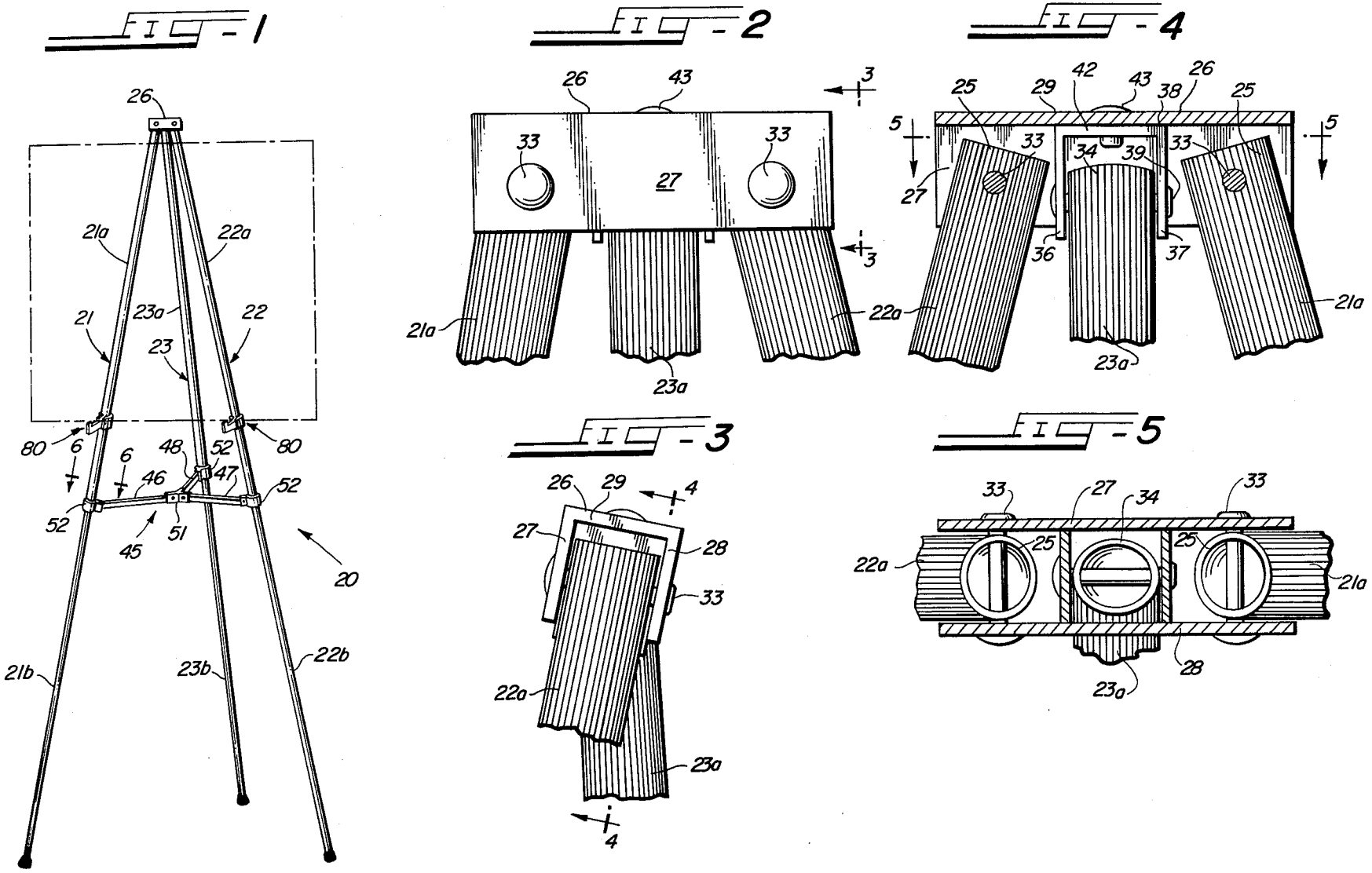
FIG. 1 is a perspective view of an adjustable easel embodying the features of the present invention and showing the parts thereof as they would appear when the easel is in an erect, operating position.
FIG. 2 is a fragmentary, enlarged front elevational view of the upper end of the easel illustrated in FIG. 1.
FIG. 3 is a fragmentary side elevational view taken substantially along the line 3—3 of FIG. 2.
FIG. 4 is a sectional view taken along the line 4—4 of FIG. 3.
FIG. 5 is a horizontal sectional view taken along the line 5—5 of FIG. 4.

In FIG. 1, an adjustable and collapsible easel embodying the features of the present invention is illustrated and indicated generally at 20. The easel 20 comprises a plurality of legs, in the present instance three legs, respectively indicated at 21–23. The legs 21–23 are in two parts, namely, first or outer tubular sections **21*a*–23*a* and second or inner sections 21*b*–23*b*, which are slidably mounted in the first leg sections 21*a*–23*a*. While the leg sections 21*b*–23*b* could be solid, they are also preferably tubular. In the present instance, the leg sections 21*a*–23*a* and 21*b*–23*b* are of aluminum tubing, circular in cross section. The manner in which the inner leg sections 21*b*–23*b* are locked against sliding movement relative to the outer leg sections 21*a*–23*a* in order to permit adjustment of the height of the easel 20** will be described more fully hereinafter.

Referring now to FIGS. 2–5, inclusive, in connection with FIG. 1, it will be seen that connecting means is provided for connecting the upper ends indicated at 25, of the first leg sections 21*a*–23*a* for articulating movement. Such connecting means preferably comprises an inverted, channel-shaped member 26 having front and rear flange portions 27 and 28 and a connecting web portion 29. In the present instance, the upper ends 25 of the leg sections 21*a* and 22*a* are connected to the connecting member 26 by rivets 33 which extend between the flange portions 27 and 28. Consequently, the legs 21 and 22 pivot in a plane which lies between and is parallel to the plane of the front and rear flange portions 27 and 28.

The upper end, indicated at 34, of the leg section 23*a* is pivotally secured between the flanges, indicated at 36 and 37 of an inverted, channel-shaped bracket 38 as by a rivet 39. The flanges 36 and 37 extend perpendicular to the flanges 27 and 28 of the connecting member 26, and the web portion, indicated at 42, of the bracket 38 is secured to the underside of the web portion 29 of the connecting member 26 as by a rivet 43. Consequently, the leg section 23*a* pivots in a plane perpendicular to the planes of movement of the leg sections 21*a* and 22*a*.

Referring now to FIGS. 6–10, inclusive, in conjunction with FIG. 1, it will be seen that the easel 20 includes foldable brace means, indicated generally at 45, for interconnecting and holding the legs 21–23 in an operative, spread position. The brace means 45 thus comprises a plurality of elongated brace members, which are preferably in the form of bars 46, 47 and 48 having their outer ends, indicated at 49, pivotally connected to a respective one of the leg sections 21*a*–23*a* and their inner ends, indicated at 50, pivotally connected to a fitting 51.

Figures 6, 7, 8, 9, 10, 11, 12:
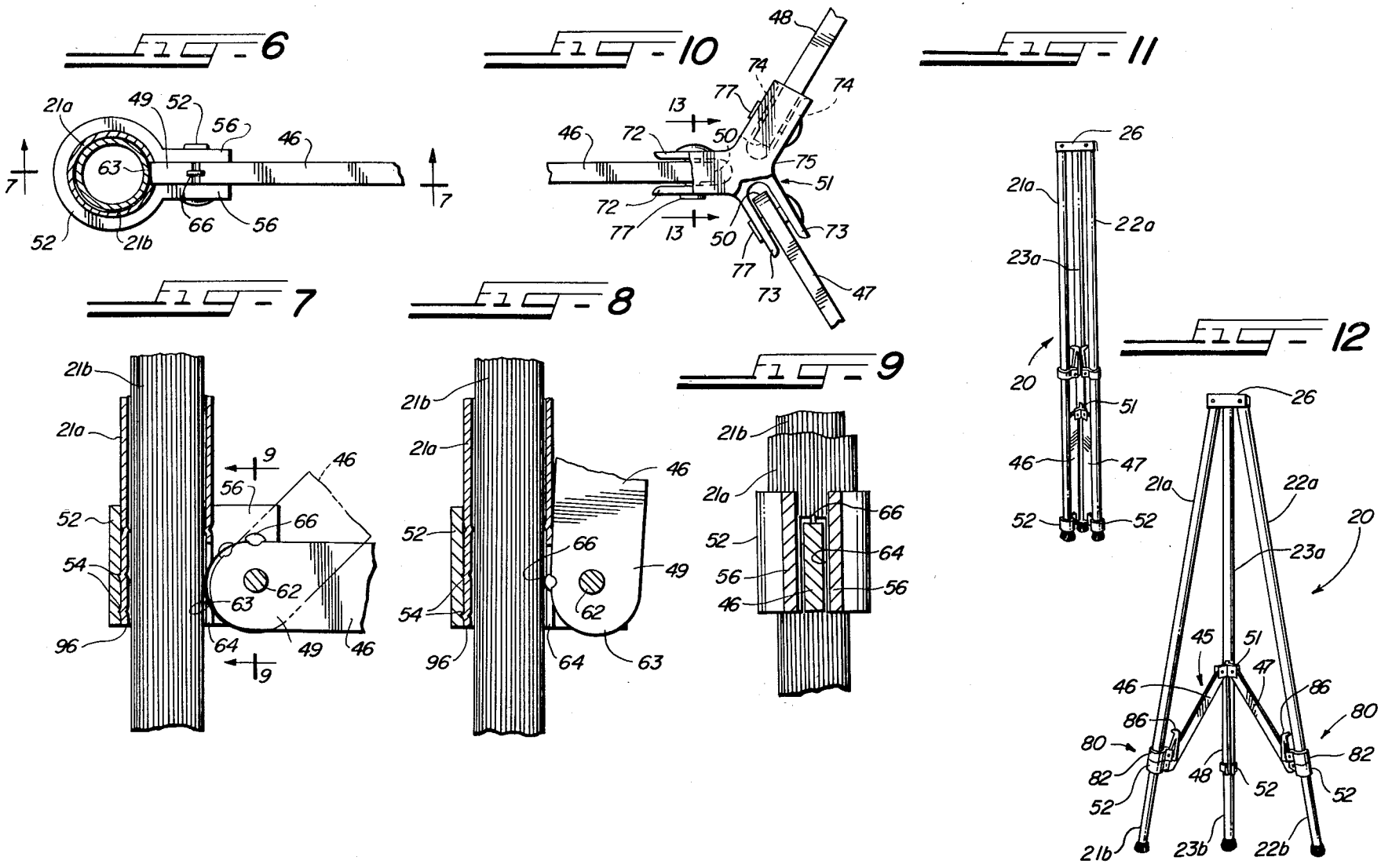
FIG. 6 is an enlarged, fragmentary, horizontal sectional view taken along the line 6—6 of FIG. 1.
FIG. 7 is a sectional view, with some parts in elevation, taken substantially along the line 7—7 of FIG. 6.
FIG. 8 is a view similar to FIG. 7 but showing the parts of the easel in a different operating position.
FIG. 9 is a sectional view taken substantially along the line 9—9 of FIG. 7.
FIG. 10 is a fragmentary, top plan view of the central hub portion of the brace of the easel.
FIG. 11 is a perspective view of the easel illustrated in FIG. 1 as the latter would appear when in a fully collapsed position for shipment or storage.
FIG. 12 is a perspective view of the easel illustrated in FIG. 12 but showing the legs thereof in partially spread positions such that the lower telescoping leg sections are unlocked and free to shift relative to the upper leg sections.
Figure 17:
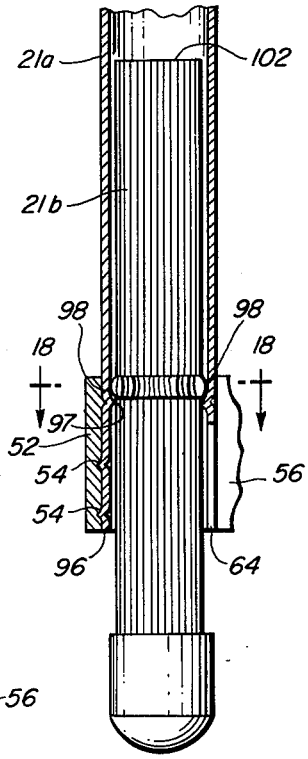
FIG. 17 is a fragmentary vertical sectional view, with some parts in elevation, showing the structure at the lower end of one of the upper leg sections and at the upper end of one of the lower leg sections which prevents the lower leg section from falling out of the upper leg section.

In order to provide the pivotal connection of the outer ends 49 of the brace members 46–48 to their respective leg sections, a split circular collar 52 (FIGS. 1 and 6) is secured to the lower end of each of the leg sections 21*a*–23*a* as by staking, indicated at 54 in FIGS. 7, 8 and 17. Each collar 52 includes a pair of outwardly extending, parallel flanges 56 for receiving a rivet 62, which pivotally connects the end 49 of a respective one of the bars 46–48 to its collar 52.

The ends 49 of the bars 46, 47 and 48 include cam means in the form of a semi-circular cam surface 63 on the outer ends 49 of the bars for engaging and preventing telescoping movement of the inner leg sections 21*b*–23*b* relative to the outer leg sections 21*a*–23*a* when the legs 21, 22 and 23 are in at least one predetermined position. In the present instance, such predetermined position comprises a substantially fully spread position of the legs and is achieved when the bars are pivoted downwardly to a substantially horizontal position or to a position generally perpendicular to the legs. To this end, the rivets 62, and hence the pivot axes of the ends 49 of the bars, are eccentric with respect to the centers of curvature of the cam surfaces 63. The above-mentioned engaged position of the cam surfaces 63 is illustrated in FIG. 1 and by the full line position of the end 49 of the brace bar 46 in FIG. 7.

In order to permit the cam surface 63 on the outer end 49 of each of the bars 46–48 to engage the outer surfaces of the tubular leg sections 21*b*–23*b*, a portion of the material at the lower end of each of the leg sections 21*a*–23*a* is removed to provide a slot 64 (FIGS. 7–9), through which the cam surface 63 on the outer end of each bar may extend.

As previously mentioned, the locking means of the easel 20 is also effective to prevent telescoping movement of the second leg sections 21*b*–23*b* relative to the first leg sections 21*a*–23*a* when the legs 21–23 are in another predetermined position. Such other predetermined position, in the present instance, comprises the substantially fully collapsed position of the leg sections 21*a*–23*a* of the easel, as illustrated in FIG. 12. To this end, another cam surface is provided on the outer end 49 of each of the brace bars 46–48 to effect the aforementioned locking. Such other cam surface is indicated at 66 in FIGS. 6–9, inclusive, and it is provided by an outwardly displaced portion of the material of the bar. Preferably, the cam surface 66 is convex in form and is created by coining the material of the bar, although other metal forming techniques could be used to provide the cam surface 66. The angular location and extent of outward protrusion of the cam surface 66 on each of the brace bars 46–48 is such that the cam surface 66 will begin to contact the outer surfaces of the second or inner tubular leg sections 21*b*–23*b* as the brace bars 46–48 approach a substantially parallel position with the outer leg sections 21*a*–23*a*.

Figure 13:
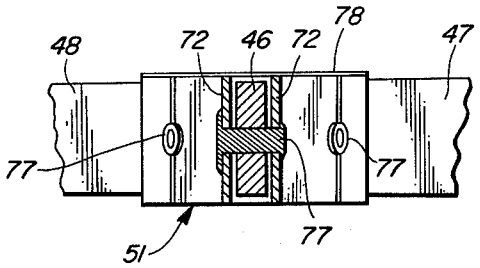
FIG. 13 is a sectional view taken along the line 13—13 of FIG. 10.

As previously mentioned, the inner ends of the brace bars 46–48 are pivotally connected to a common connecting member or fitting 51. The fitting 51 preferably includes three pairs of equidistantly spaced, outwardly extending flanges 72, 73 and 74, which are connected to a common integral hub 75. The inner ends 50 of the brace bars 46–48 are pivotally connected to the fitting 51 as by rivets 77 extending through the flanges 72, 73 and 74, respectively. A piece of covering material 78 (FIGS. 10 and 13) may be adhered to the upper surface of the fitting 51, and instructions (not shown) may be provided on the upper surface of the material 78 as to the operation of the easel 20.

With the foregoing construction and assuming the easel 20 is in a fully collapsed position as shown in FIG. 11, the inner or second leg sections 21*b*–23*b* are prevented from shifting longitudinally and/or rotating relative to the first or outer leg sections 21*a*–23*a* due to the frictional engagement of the cam surfaces 66 with the leg sections 21*b*–23*b*.

However, when it is desired to release the leg sections 21*b*–23*b*, it is only necessary to manually spread the upper leg sections 21*a*–23*a* a sufficient distance to disengage the cam surfaces 66 from the leg sections 21*b*–23*b*. The approximate positions of the leg sections 21*a*–23*a* when release occurs is illustrated by the full line positions of the leg sections 21*a*–23*a* in FIG. 12. At this time, the brace bars 46–48 are inclined at acute angular positions with respect to the leg sections 21*a*–23*a*. This relationship is also illustrated by the phantom line position of the brace bar 46 in FIG. 7.

Figure 14:
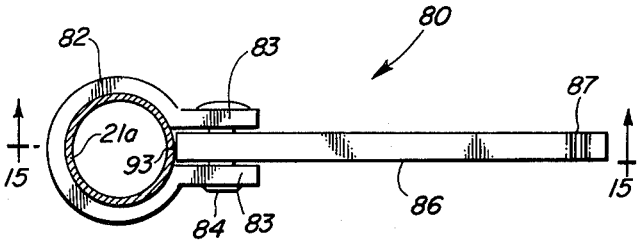
FIG. 14 is a sectional view through one of the upper leg sections of the easel illustrated in FIG. 1 and showing the relationship of one of the support members of the easel when the latter is in an operative position.
Figure 15:
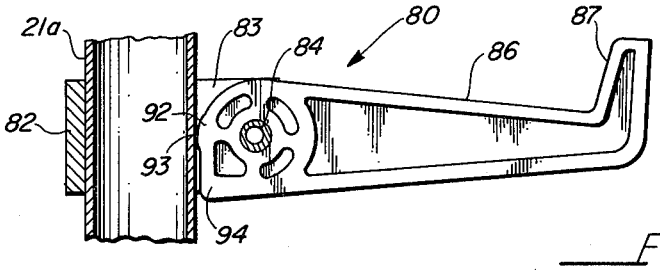
FIG. 15 is a sectional view taken substantially along the line 15—15 of FIG. 14.
Figure 16:
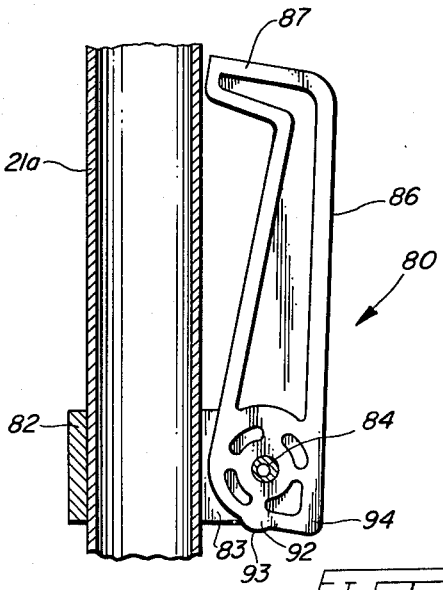
FIG. 16 is a view similar to FIG. 15 but showing the support arm in an inoperative position permitting the mounting collar and support arm to be longitudinally or rotatably shifted on the leg section.

Referring now to FIGS. 14–16, inclusive, in conjunction with FIG. 1, the easel 20 includes at least one and preferably a pair of adjustable support means, indicated generally at 80, embodying the features of the present invention and mounted on the leg sections 21*a* and 22*a* for supporting an item to be displayed on the easel. Each adjustable support means 80 comprises a mounting member in the form of a split collar 82 (FIGS. 14–16) which is slidably and rotatably mounted on the leg sections 21*a* and 22*a*. Each collar 82 has a pair of parallel flanges 83 extending outwardly from the edges of the split. A rivet 84 extends through the flanges 83 and one end of an elongated support member in the form of an arm 86 is pivotally connected to the collar 82. The outer end of the arm 86 may be provided with an upwardly extending finger 87 to prevent an item resting or supported thereon from sliding off of the arm when the easel is in use.

According to the present invention, each adjustable support means 80 includes locking means carried by the support member or arm 86 and operable in response to pivotal movement of the arm from an inoperative position extending generally parallel to the leg section, the leg section 21*a* being illustrated in FIGS. 14–16, to an operative position extending generally perpendicular to the leg section for locking the collar 82 against sliding and rotational movement relative to the leg section. Such locking means preferably comprises an enlarged portion or boss 92 on the pivot end of the arm 86 for frictionally engaging the outer surface of the leg section 21*a*. The engaging surface, indicated at 93, of the boss 92 is preferably convex. Thus, when the arm 86 is in its operative position illustrated in FIGS. 14 and 15, the frictional engagement between the surface 93 of the boss 92 and the leg section 21*a* is such as to prevent any relative sliding or rotational movement of the collar 82 on the leg section.

In order to prevent the arm 86 from pivoting beyond its operative position illustrated in FIG. 15, stop means is provided. Such stop means preferably comprises an abutment in the form of a nose 94 on the pivot end of the arm 86 and spaced from the boss 92. The arrangement is such that the nose 94 contacts the outer surface of the leg section when the engaging surface 93 of the boss 92 is exerting its greatest restraining force on the leg section.

From the foregoing, it will now be apparent that each support means 80 can be rapidly and easily shifted to any desired longitudinal and relatively rotated position on the leg sections 21*a* and 22*a* of the easel 20 and locked in such position merely by pivoting the arms 86 thereof downwardly or to a position extending generally perpendicular to the leg section, as illustrated in FIG. 15. Release of each support means 80 is effected merely by pivoting the arm 86 thereof upwardly or toward a position in which the arm is generally parallel to the leg section, as illustrated in FIG. 16.

Figure 18:
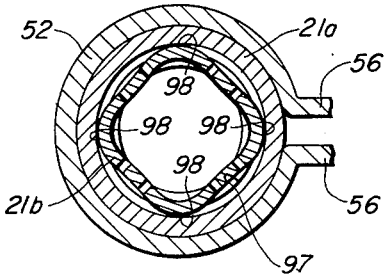
FIG. 18 is an enlarged sectional view taken along the line 18—18 of FIG. 17.

In order to prevent the second or inner leg sections 21*b*–23*b* from falling out of the lower ends, indicated at 96, of the first or outer leg sections 21*a*–23*a*, an annular, radially inward crimp 97 (FIG. 17) is provided adjacent to the lower end 96 of the leg sections 21*a*–23*a*, and at least one and preferably a plurality of circumferentially spaced radially outward protrusions 98 (FIG. 18) are provided adjacent to the upper end, indicated at 102, of each of the inner leg sections 21*b*–23*b*, for coaction with the crimps 97. In other words, since the internal diameter of the outer leg sections 21*a*–23*a* at the crimps 97 is less than the outside diameter of the inner leg sections 21*b*–23*b*, at the protrusions 98, the inner leg sections 21*b*–23*b* are prevented from falling out of the lower ends 96 of the outer leg sections 21*a*–23*a* when the inner legs sections 21*a*–23*a* are not engaged by the cam surfaces 63 and 66.

While only one embodiment of the invention has been herein illustrated and described, it will be understood that modifications and variations thereof may be effected without departing from the spirit of the invention as defined in the appended claims.

We claim:

1. In an adjustable and collapsible easel adapted to be mounted in an upright position and including a plurality of elongated legs, each of said legs including a first tubular section having upper and lower ends and a second section mounted in said first section for telescoping movement relative thereto, means connecting the upper ends of said first leg sections for articulated movement, brace means interconnecting said first leg sections, and support means carried by at least one of said legs for supporting an article on said easel, the improvement comprising locking means associated with said brace means for locking the second leg section of each of said legs against telescoping movement relative to said first leg section, said locking means effecting said locking in response to movement of said legs to at least one predetermined position.

2. The easel of claim 1, in which said brace means includes a plurality of elongated brace members, said brace members being pivotally connected to each other at one of their respective ends, the opposite ends of said brace members being pivotally connected to respective ones of said first leg sections, and said locking means comprises cam means on each of said opposite ends of said brace members, said cam means being operable to frictionally engage said second leg sections and prevent movement thereof relative to said first leg sections when said legs are in said one predetermined position.

3. The easel of claim 1, in which said one predetermined position comprises a substantially fully spread position of said legs.

4. The easel of claim 2, in which said cam means comprises a substantially semi-circular cam surface on the opposite end of each of said brace members, the pivot axes of the opposite ends of said brace members being eccentric with respect to the centers of curvature of said cam surfaces so as to cause said cam surfaces to engage their respective second leg sections when said legs are substantially fully spread.

5. The easel of claim 4, in which said cam surfaces engage said second leg sections when said brace members are substantially perpendicular to said first leg sections.

6. The easel of claim 5, in which said cam surfaces are disengaged from said second leg sections when said legs are in a partially spread position and said brace members are inclined at an acute angle with respect to said first leg sections.

7. The easel of claim 2, in which a split collar encircles and is connected to the lower end of each of said first leg sections, the opposite ends of said brace members are pivotally connected to said collars, and a portion of the material of said first leg sections in the vicinity of the splits in said collar is removed to permit the cam surfaces on said brace members to frictionally engage and prevent relative movement of said second leg sections relative to said first leg sections.

8. The easel of claim 2, in which said locking means includes another cam surface on the opposite end of each of said brace members, said other cam surfaces being operable to frictionally engage said second leg sections when said legs are in another predetermined position.

9. The easel of claim 8, in which said other predetermined position comprises a substantially fully folded position of said legs with said brace members disposed substantially parallel to said first leg sections.

10. The easel of claim 8, in which said other cam surfaces are provided by outwardly displaced portions of the material of said brace members.

11. The easel of claim 10, in which the outer periphery of each of said outwardly displaced portions is generally convex.

12. The easel of claim 10, in which said outwardly displaced portions are formed by coining.

13. The easel of claim 9, in which said one end of each of said brace members is pivotally connected to a common connecting member, whereby shifting of said connecting member to a lower limit position when said easel is in an upright position and said leg members are in other than a fully spread position effects spreading of said legs and shifting said connecting member to an upper limit position when said easel is in an upright position and said legs are in other than a fully folded position effects full folding of said legs and locking of the same in said fully folded position.

* * * * *